US012735882B2

(12) United States Patent
Tsai

(10) Patent No.: US 12,735,882 B2
(45) Date of Patent: Sep. 15, 2026

(54) FLUSH TOILET

(71) Applicant: Global One Tech Corporation, Taichung City (TW)

(72) Inventor: Tien-Shou Tsai, Taichung City (TW)

(73) Assignee: GLOBAL ONE TECH CORPORATION, Taichung City (TW)

( * ) Notice: Subject to any disclaimer, the term of this patent is extended or adjusted under 35 U.S.C. 154(b) by 119 days.

(21) Appl. No.: 18/796,046

(22) Filed: Aug. 6, 2024

(65) Prior Publication Data

US 2025/0369218 A1 Dec. 4, 2025

(30) Foreign Application Priority Data

Jun. 3, 2024 (TW) ..... 113120501

(51) Int. Cl.
*E03D 11/02* (2006.01)
*E03D 1/30* (2006.01)

(52) U.S. Cl.
CPC ..... *E03D 11/02* (2013.01); *E03D 1/30* (2013.01)

(58) Field of Classification Search
CPC ..... E03D 11/02; E03D 1/30; E03D 5/105
USPC ..... 4/300
See application file for complete search history.

(56) References Cited

U.S. PATENT DOCUMENTS 4,462,124 A * 7/1984 Antos ..... E03D 1/141 4/364
5,204,999 A * 4/1993 Makita ..... E03D 9/16 4/300
5,502,845 A * 4/1996 Hayashi ..... E03D 11/02 4/425
5,950,983 A * 9/1999 Jahrling ..... E03D 5/105 4/313
6,502,251 B1 * 1/2003 Teshima ..... E03D 1/36 4/425
7,325,258 B2 * 2/2008 Asada ..... E03D 11/08 4/363
9,021,622 B2 * 5/2015 Kitaura ..... E03D 11/08 4/425
10,895,069 B1 * 1/2021 Tsai ..... E03D 1/304
10,975,556 B2 * 4/2021 Tsai ..... E03D 1/186
11,486,122 B2 * 11/2022 Kawazu ..... E03D 1/26
11,560,703 B2 * 1/2023 Kuru ..... E03D 11/02
(Continued)

FOREIGN PATENT DOCUMENTS

CA 3077076 C * 4/2022 ..... E03D 1/145
WO WO-2022031247 A1 * 2/2022 ..... E03D 5/105

*Primary Examiner* — Lori L Baker
(74) *Attorney, Agent, or Firm* — HSML P.C.

(57) ABSTRACT

A flush toilet includes a toilet stool unit, a toilet seat, a toilet cover, a water tank unit defining a water storage space, a pipe unit, an electric switching valve, a flush valve, a manual actuating unit, a driver coupled to the toilet cover, and a sensor control unit. The pipe unit includes a flow-out pipe, and first and second flow-in pipes disposed downstream of the water storage space and upstream of the flow-out pipe. The electric switching valve is connected in series between the flow-out pipe and the first flow-in pipe. The flush valve is disposed upstream of the second flow-in pipe and is actuated to move by the manual actuating unit. The sensor control unit is disposed for controlling switching of the electric switching valve between blocked and communicated states, and for controlling the driver to drive the toilet cover to move between covering and uncovering positions.

10 Claims, 15 Drawing Sheets

(56) References Cited

U.S. PATENT DOCUMENTS

| | | | | |
|---|---|---|---|---|
| 12,497,769 | B2 * | 12/2025 | Okabe | E03D 1/26 |
| 2015/0026876 | A1 * | 1/2015 | Shirakawa | E03D 11/08 4/420 |
| 2020/0308816 | A1 * | 10/2020 | Kashirajima | E03D 1/38 |
| 2025/0043556 | A1 * | 2/2025 | Okabe | E03D 1/26 |
| 2025/0277359 | A1 * | 9/2025 | Kamezaki | E03D 1/34 |

* cited by examiner

FLUSH TOILET

CROSS-REFERENCE TO RELATED APPLICATION

This application claims priority to Taiwanese Invention Patent Application No. 113120501, filed on Jun. 3, 2024, which is incorporated by reference herein in its entirety.

FIELD

The disclosure relates to a toilet, and more particularly to a flush toilet.

BACKGROUND

Generally, a user of a conventional flush toilet normally needs to press a button that is disposed on a water tank to flush excreta away from the conventional flush toilet. In a case where the user forgets to flush the toilet, a hygienic environment may not be available for subsequent users. In addition, since most users are afraid of getting their hands dirty and rarely close the toilet cover after using the conventional flush toilet, water may splash out of the conventional flush toilet during flushing, which adversely affects hygiene of the environment around the conventional flush toilet.

SUMMARY

Therefore, an object of the disclosure is to provide a flush toilet that can alleviate at least one of the drawbacks of the prior art.

According to the disclosure, the flush toilet includes a toilet stool unit, a toilet seat, a toilet cover, a water tank unit, a pipe unit, an electric switching valve, a flush valve, a manual actuating unit, a driver, and a sensor control unit. The toilet stool unit defines a bowl space. The toilet seat is pivotably disposed on the toilet stool unit. The toilet cover is pivotably mounted to the toilet stool unit, and is movable relative to the toilet stool unit between a covering position to close the bowl space and an uncovering position to open the bowl space. The water tank unit includes an outer tank body, an inner tank body disposed in the outer tank body and defining a water storage space therein, and a cover member disposed detachably on a top portion of the outer tank body, and having a front side that is formed with a mounting slot extending therethrough. The pipe unit includes a flow-out pipe, a first flow-in pipe, and a second flow-in pipe. The flow-out pipe is in fluid communication with the bowl space and is disposed upstream of the bowl space. The first flow-in pipe is disposed downstream of the water storage space and is in fluid communication with the water storage space. The second flow-in pipe is disposed downstream of the water storage space and is in fluid communication with the flow-out pipe. The electric switching valve is connected in series between the flow-out pipe and the first flow-in pipe, and is switchable between a blocked state and a communicated state. When the electric switching valve is in the blocked state, fluid communication between the flow-out pipe and the first flow-in pipe is blocked. When the electric switching valve is in the communicated state, the flow-out pipe and the first flow-in pipe are in fluid communication with each other. The flush valve is disposed upstream of the second flow-in pipe and is switchable between a closed state and an open state. When the flush valve is in the closed state, fluid communication between the second flow-in pipe and the water storage space is blocked. When the flush valve is in the open state, the second flow-in pipe and the water storage space are in fluid communication with each other. The manual actuating unit is coupled to the flush valve for actuating movement of the flush valve from the closed state to the open state. The driver is mounted to the toilet stool unit, and is coupled to the toilet cover for driving the toilet cover to move between the covering position and the uncovering position. The sensor control unit includes at least one sensor disposed in the mounting slot, and a controller signally connected to the at least one sensor, and signally connected to the electric switching valve and the driver. The sensor control unit is disposed for controlling switching of the electric switching valve between the blocked state and the communicated state, and for controlling the driver to drive the toilet cover to move between the covering position and the uncovering position.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
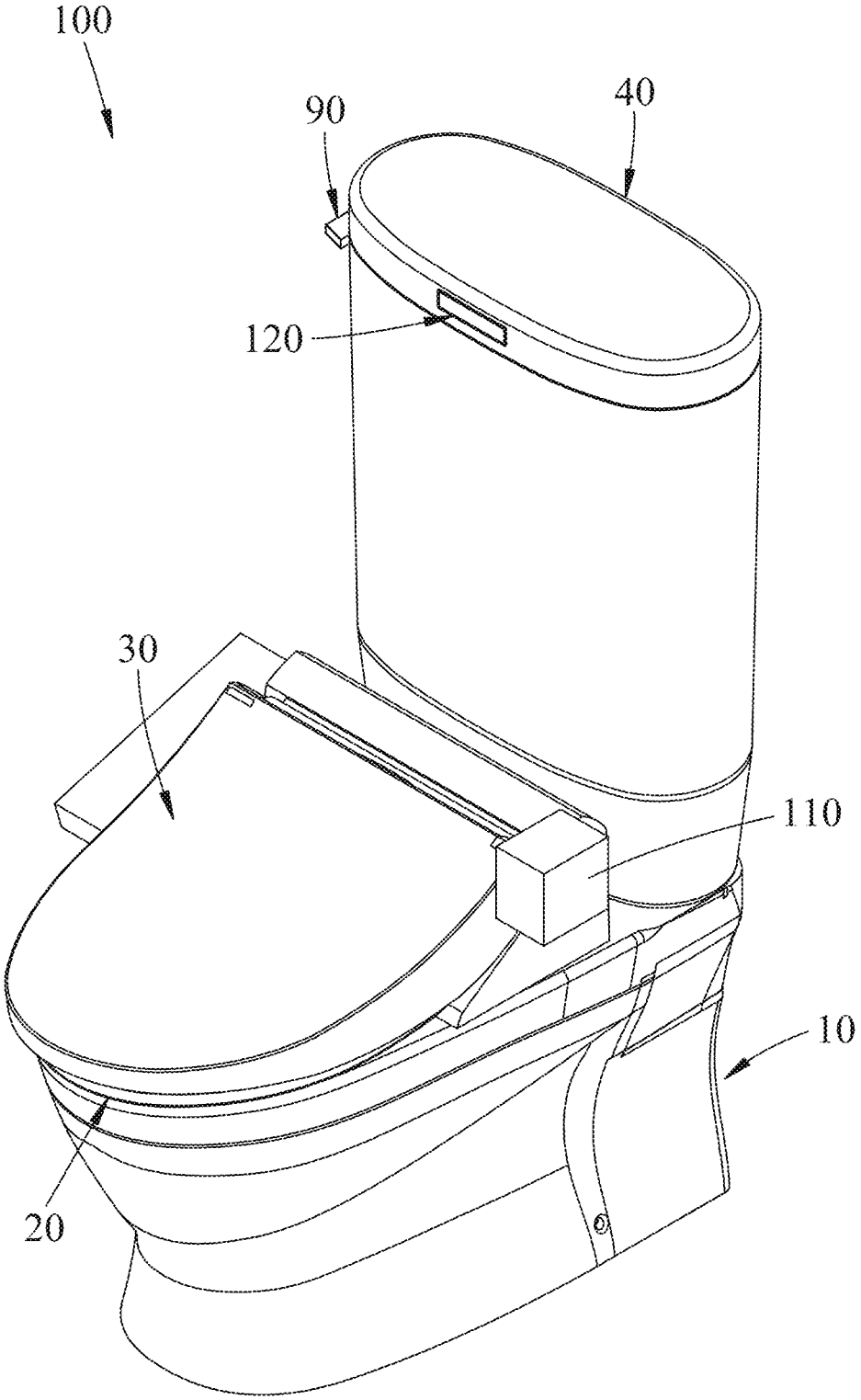
FIG. 1 is a perspective view of an embodiment of a flush toilet according to the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently e.g., rotated 90 degrees or at other orientations and the spatially relative terms used herein may be interpreted accordingly.

Figure 5:
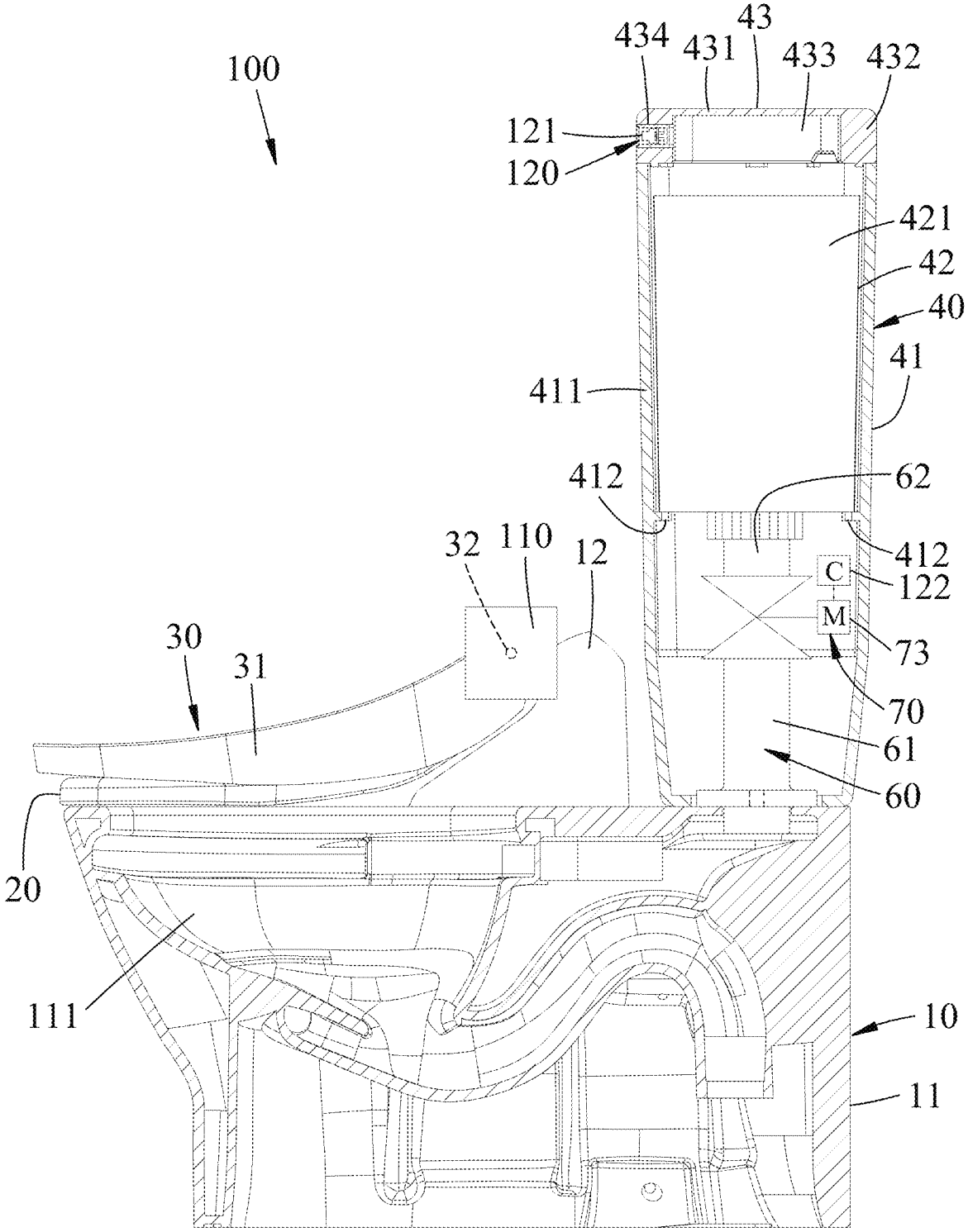
FIG. 5 is a partly sectional side view of the embodiment.
Figure 6:
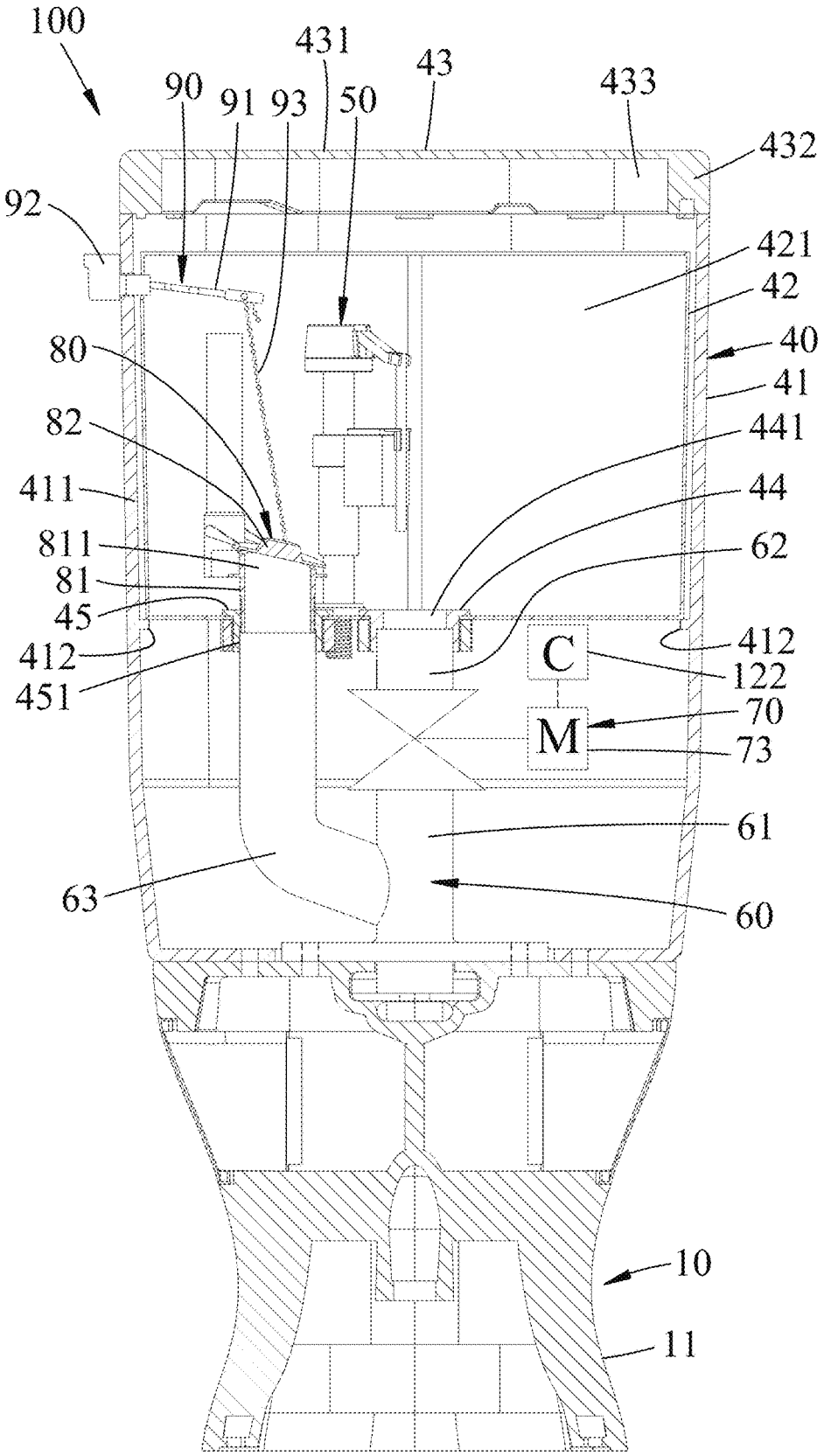
FIG. 6 is a partly sectional front view of the embodiment, illustrating an electric switching valve and a flush valve of the embodiment.

Referring to FIGS. 1, 5 and 6, an embodiment of a flush toilet 100 of the present disclosure is shown. The flush toilet 100 includes a toilet stool unit 10, a toilet seat 20, a toilet cover 30, a water tank unit 40, a water inlet valve 50, a pipe unit 60, an electric switching valve 70, a flush valve 80, a manual actuating unit 90, a driver 110, and a sensor control unit 120.

Figure 2:
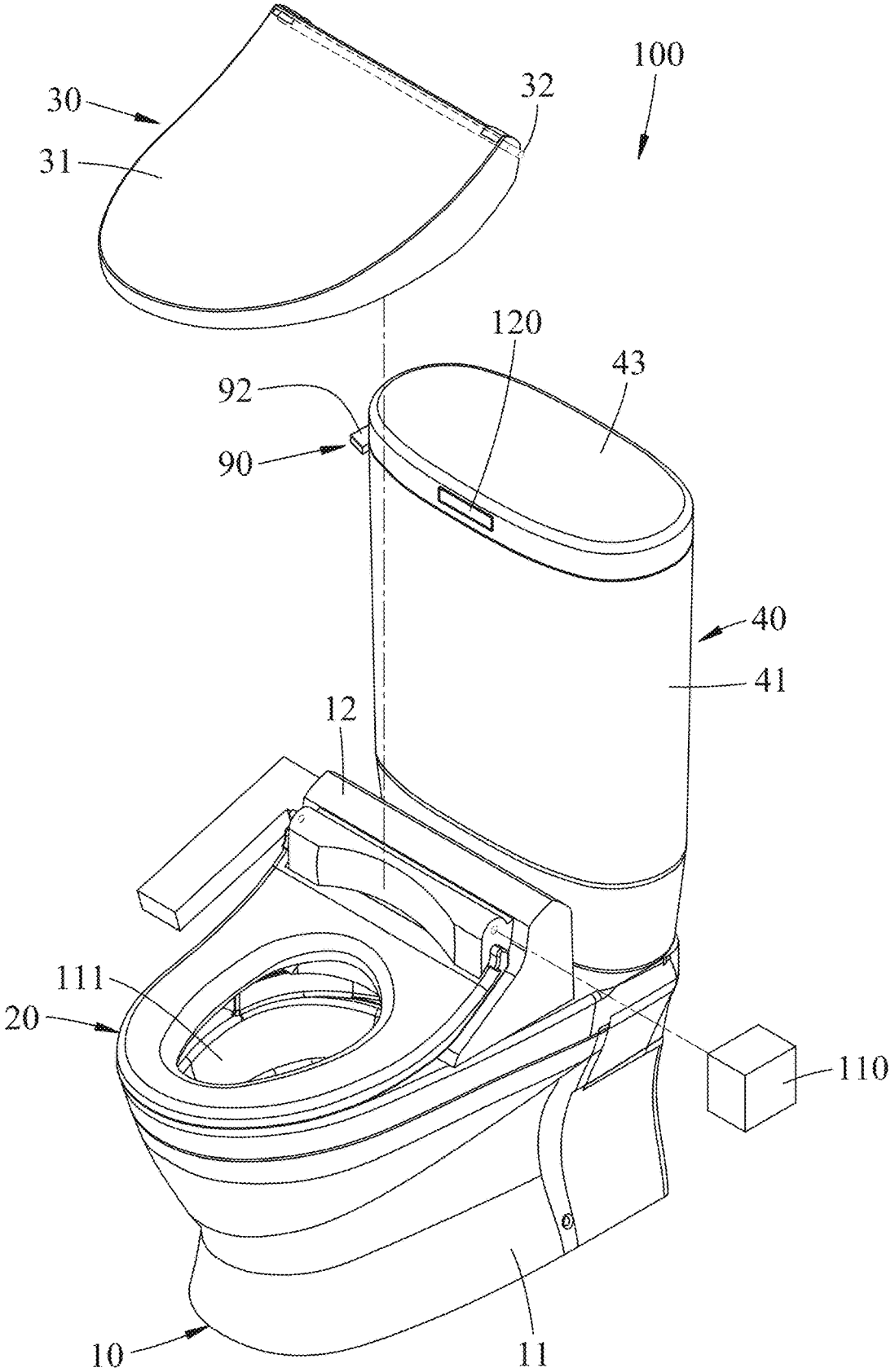
FIG. 2 is a partly exploded perspective view of the embodiment.
Figure 3:
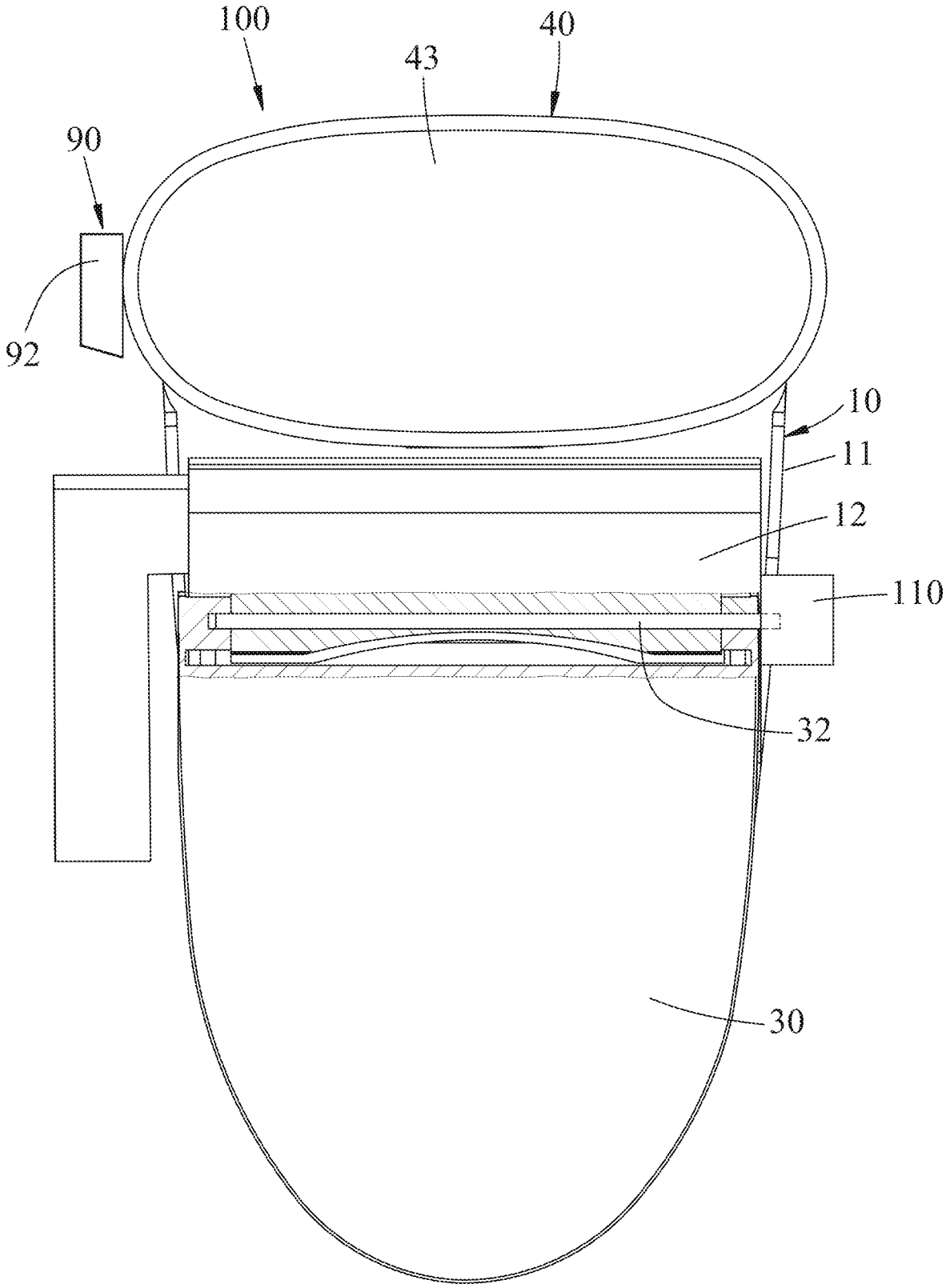
FIG. 3 is a partly sectional top view of the embodiment.
Figure 4:
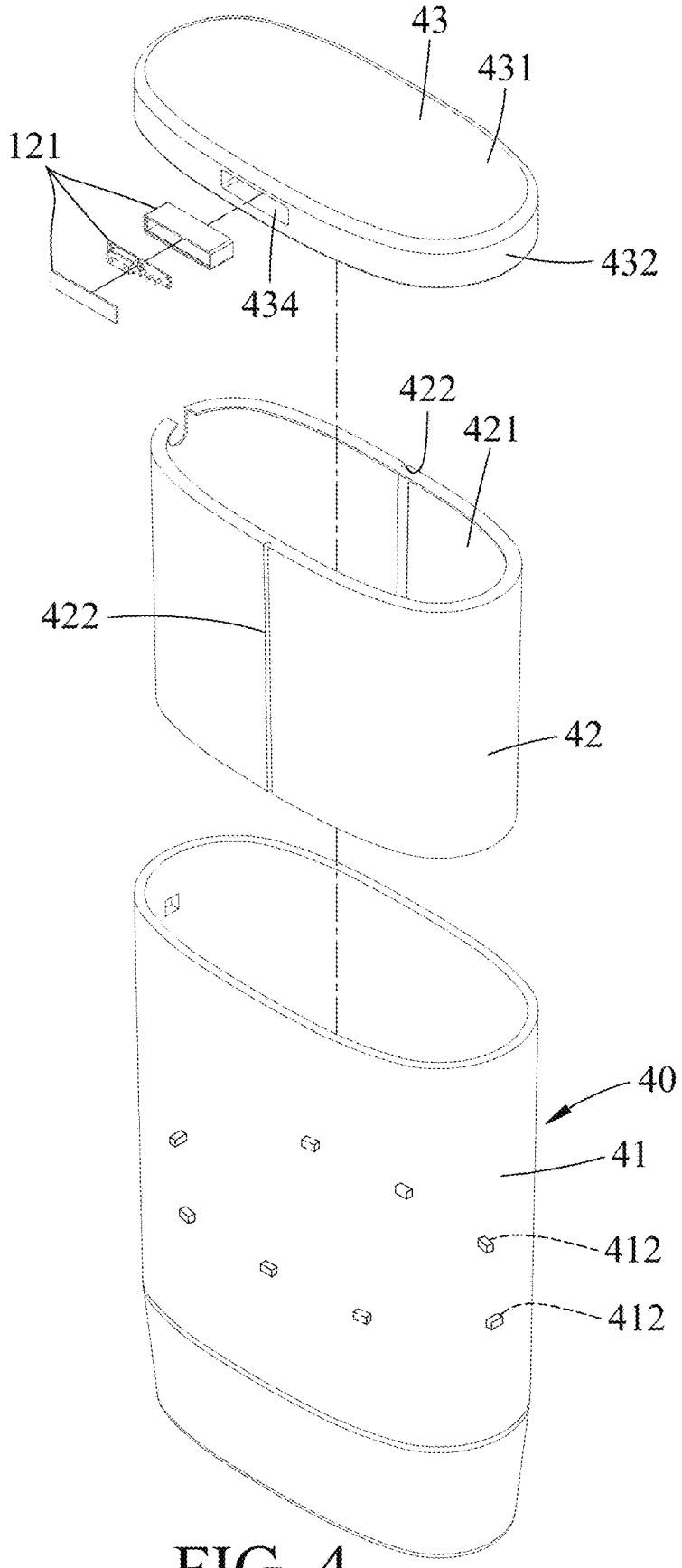
FIG. 4 is an exploded perspective view of a water tank unit and a sensor of a sensor control unit of the embodiment.

As shown in FIGS. 2, 3 and 4, the toilet stool unit 10 includes a toilet stool 11 defining a bowl space 111, and a mounting seat 12 disposed on a top surface of the toilet stool 11.

The toilet seat 20 is pivotably disposed on the mounting seat 12 of the toilet stool unit 10.

The toilet cover 30 is pivotably mounted to the mounting seat 12 of the toilet stool unit 10, and is movable relative to the toilet stool unit 10 between a covering position (see FIG. 5) to close the bowl space 111 and an uncovering position (see FIG. 10) to open the bowl space 111. In this embodiment, the toilet cover 30 includes a cover body 31, and a pivot shaft 32 extending through the cover body 31 and connecting the cover body 31 pivotably to the mounting seat 12.

As shown in FIGS. 4, 5, and 6, the water tank unit 40 includes an outer tank body 41, an inner tank body 42 disposed in the outer tank body 41 and defining a water storage space 421 therein, a cover member 43 disposed detachably on a top portion of the outer tank body 41, a first water discharge unit 44 disposed in the inner tank body 42, and a second water discharge unit 45 disposed in the inner tank body 42.

The outer tank body 41 includes a periphery wall 411, and a plurality of blocks 412 disposed on an inner surface of the periphery wall 411 and protruding inwardly therefrom.

The inner tank body 42 has a bottom surface abutting against the blocks 412, and an outer peripheral surface formed with two wiring grooves 422. The wiring grooves 422 are provided for passage of electric wires (not shown). It may be appreciated that the numbers of the wiring grooves 422 may be one or more than two in other variations of the embodiment.

The cover member 43 has a cover top wall 431, a cover peripheral wall 432 extending downwardly from a periphery of the cover top wall 431, and a front side formed with a mounting slot 434 extending therethrough. The cover top wall 431 and the cover peripheral wall 432 cooperatively define an inner space 433 in fluid communication with the mounting slot 434. In this embodiment, the cover peripheral wall 432 has the front side and is formed with the mounting slot 434.

The first water discharge unit 44 defines a first discharging hole 441 disposed downstream of the water storage space 421. The second water discharge unit 45 defines a second discharging hole 451 disposed downstream of the water storage space 421. In this embodiment, the first water discharge unit 44 is mounted to a bottom portion of the inner tank body 42 and extends through the inner tank body 42 such that the first discharging hole 441 is disposed downstream of the water storage space 421. The second water discharge unit 45 is also mounted to the bottom portion of the inner tank body 42 and extends through the inner tank body 42 such that the second discharging hole 451 is disposed downstream of the water storage space 421.

In this embodiment, the outer tank body 41 is disposed on a top surface of the toilet stool 11 and is adjacent to a rear portion of the toilet stool 11, and the mounting seat 12 is adjacent to the outer tank body 41.

As shown in FIG. 6, the water inlet valve 50 is disposed in the inner tank body 42 and has a bottom end extending outwardly of the inner tank body 42. In this embodiment, the water inlet valve 50 is in fluid communication with a water supply (not shown).

As shown in FIGS. 5 and 6, the pipe unit 60 includes a flow-out pipe 61 in fluid communication with the bowl space 111 and disposed upstream of the bowl space 111, a first flow-in pipe 62 disposed downstream of the water storage space 421 and in fluid communication with the water storage space 421, and a second flow-in pipe 63 disposed downstream of the water storage space 421 and in fluid communication with the flow-out pipe 61. In this embodiment, the first flow-in pipe 62 is connected to the first water discharge unit 44 and is disposed downstream of the first discharging hole 441, and the second flow-in pipe 63 is connected to the second water discharge unit 45 and is disposed downstream of the second discharging hole 451.

In this embodiment, the flow-out pipe 61 extends into the outer tank body 41, and the first flow-in pipe 62 and the second flow-in pipe 63 are disposed in the outer tank body 41.

Figure 7:
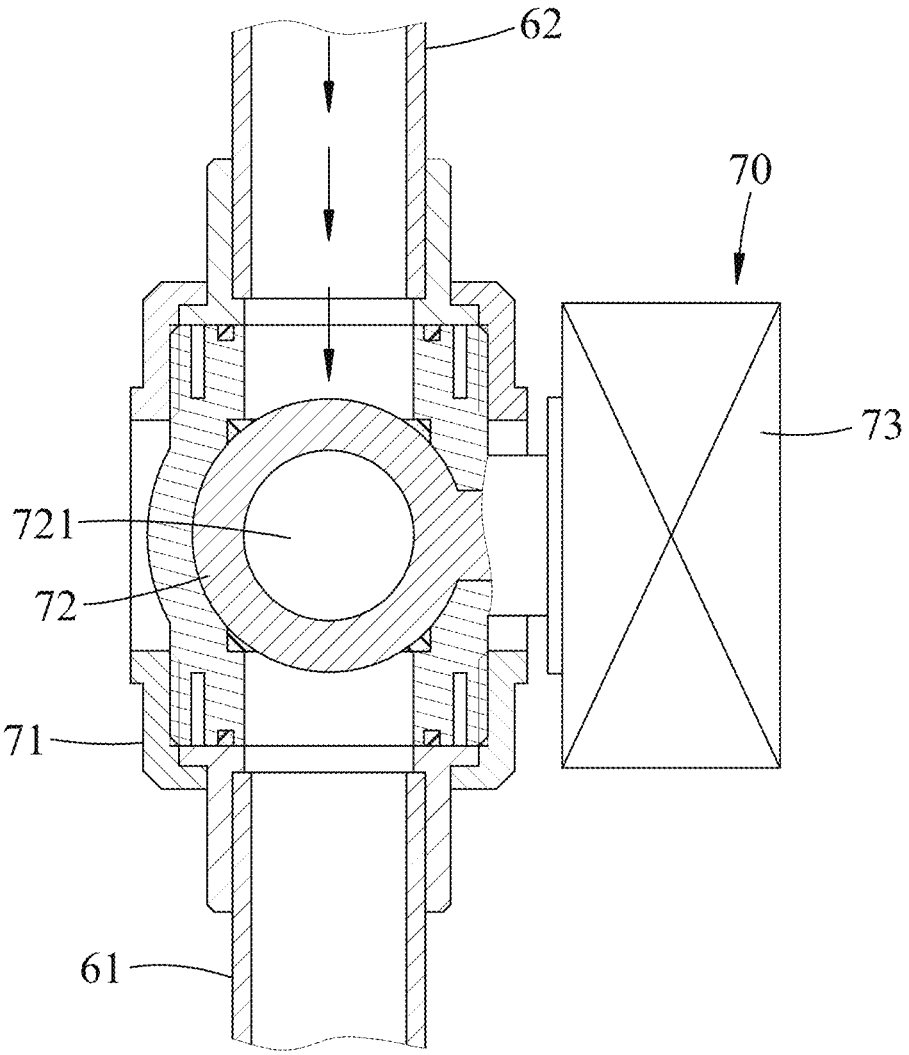
FIG. 7 is a fragmentary, partially cross-sectional view of the embodiment, illustrating a pipe unit of the embodiment and the electric switching valve in a blocked state.
Figure 8:
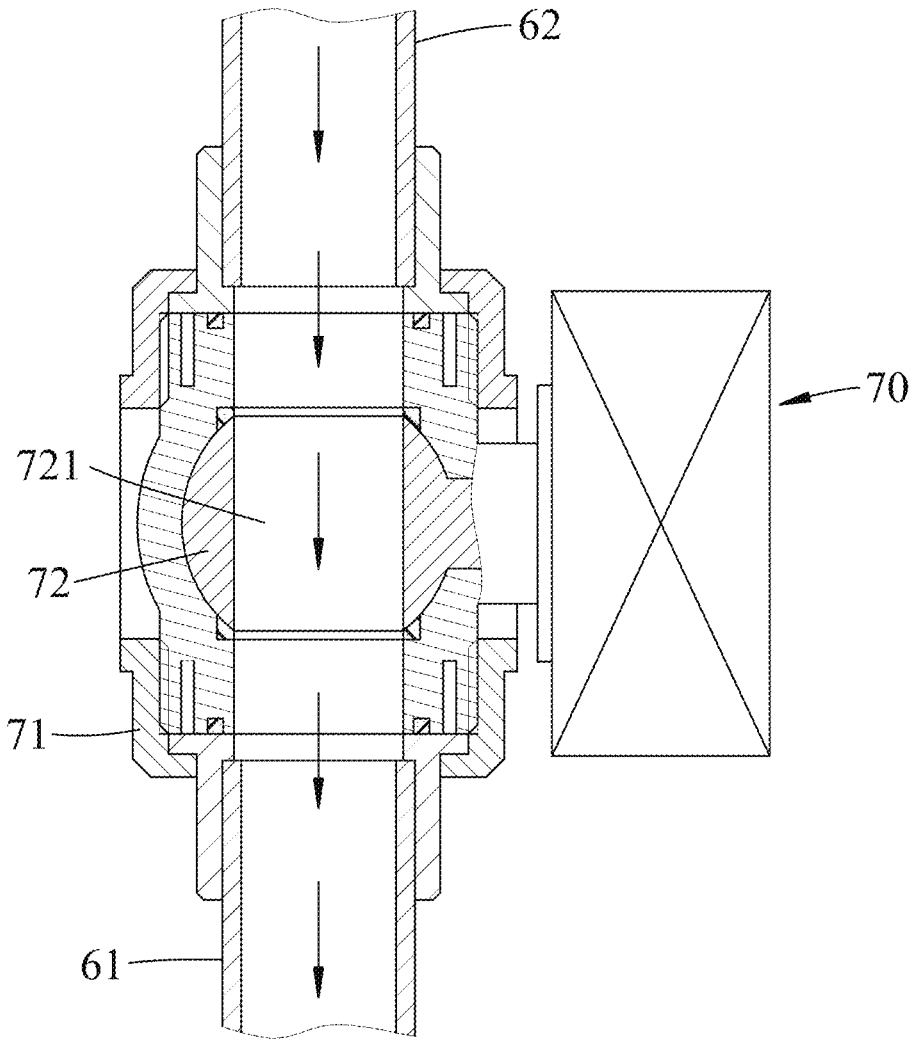
FIG. 8 is similar to FIG. 7, but illustrates the electric switching valve in a communicated state.

The electric switching valve 70 is connected in series between the flow-out pipe 61 and the first flow-in pipe 62, and is switchable between a blocked state (see FIGS. 7, 12) and a communicated state (see FIG. 8, 14). In this embodiment, the electric switching valve 70 is disposed in the outer tank body 41.

In this embodiment, as shown in FIGS. 7 and 8, the electric switching valve 70 is an electric ball valve that includes a valve body 71, and a valve gate 72 and a drive motor 73. The valve gate 72 is in the form of a ball, is rollably disposed inside the valve body 71, and has a communication hole 721. The drive motor 73 is disposed for driving the rolling of the valve gate 72.

Figure 12:
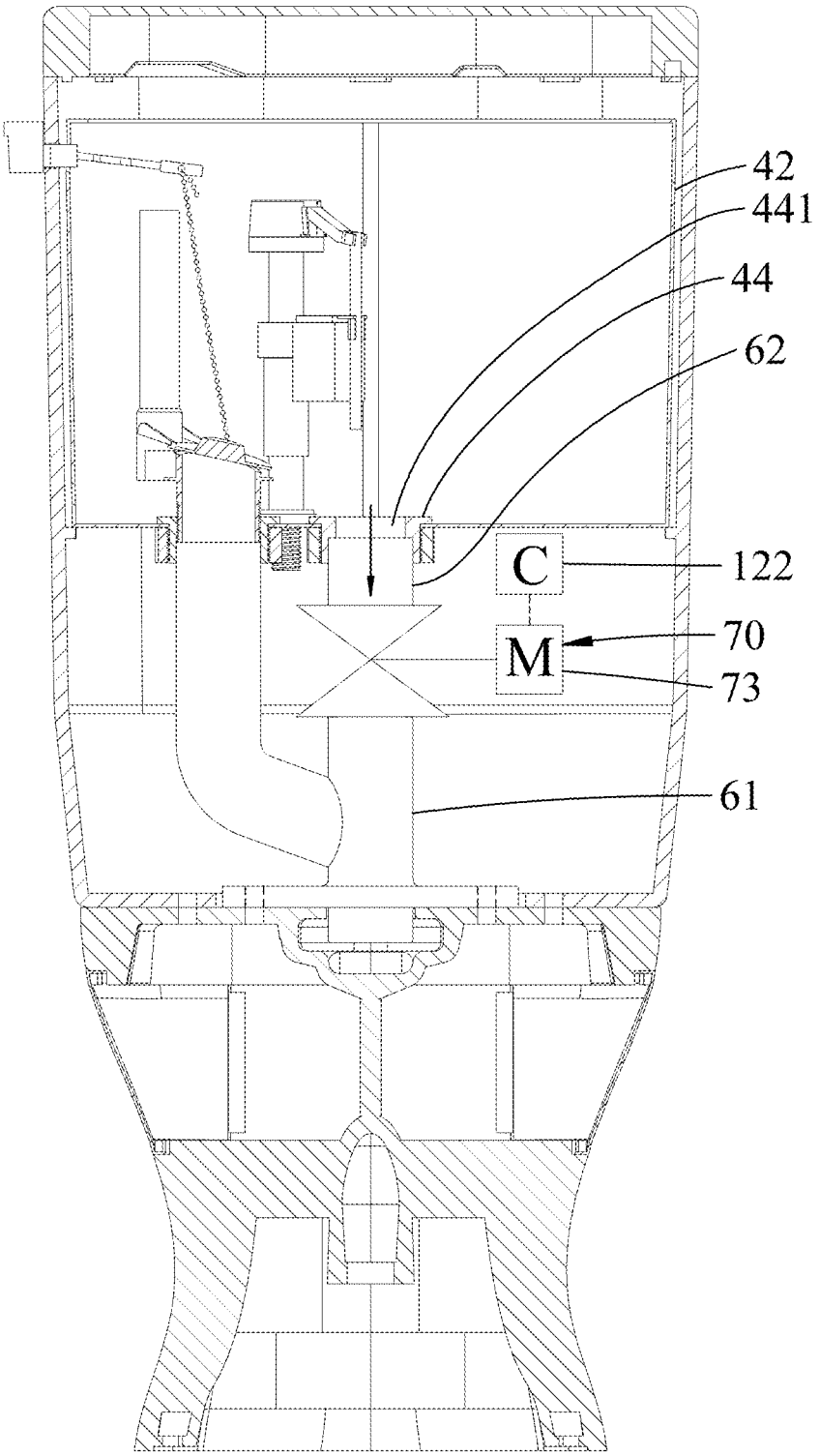
FIG. 12 is a view similar to FIG. 6, but illustrates that the electric switching valve is in the blocked state and the flush valve is in a closed state.
Figure 14:
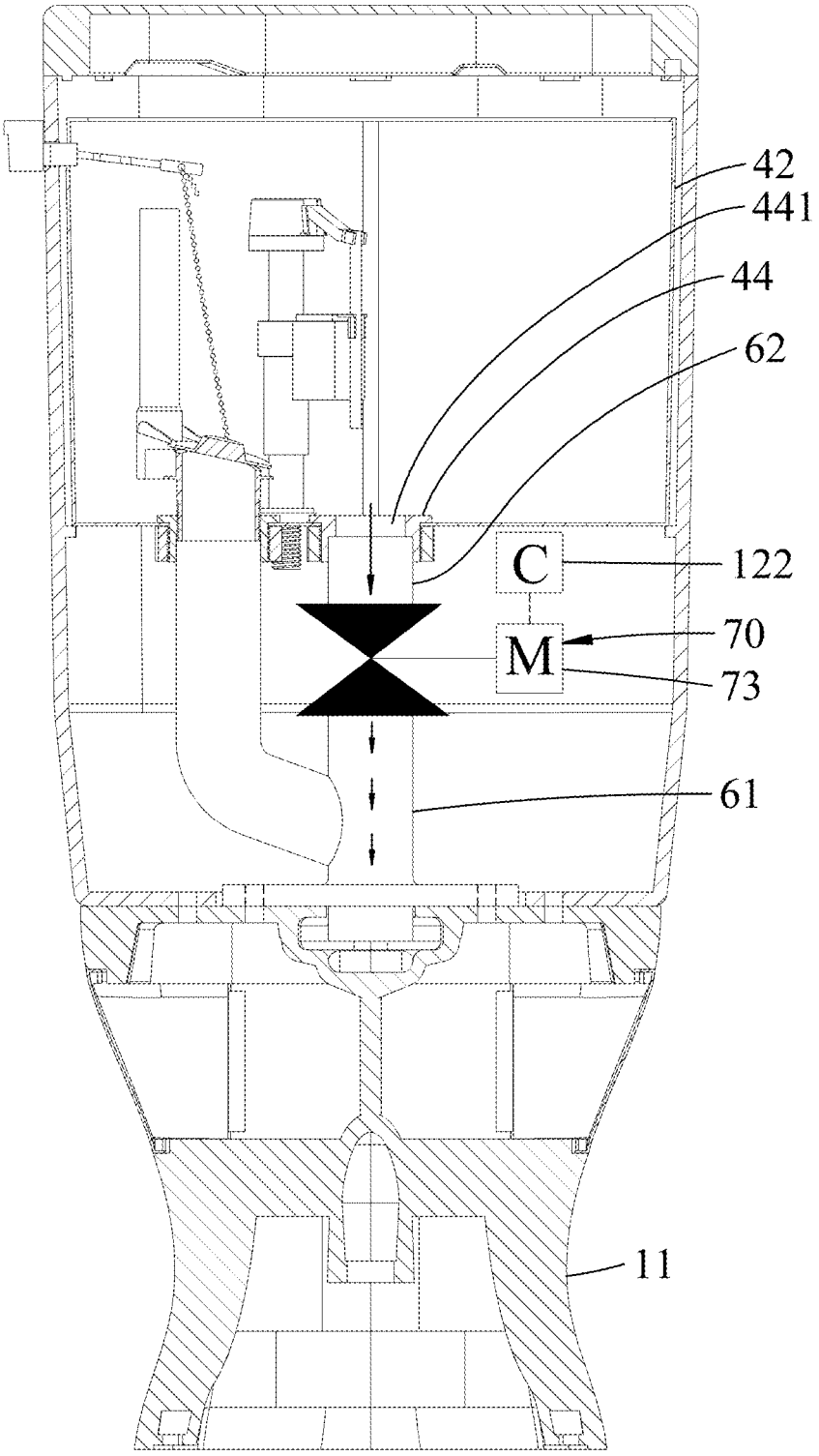
FIG. 14 is a view similar to FIG. 12, but illustrates that the electric switching valve is in the communicated state and the flush valve is in the closed state.

As shown in FIGS. 7 and 12, when the electric switching valve 70 is in the blocked state, fluid communication between the flow-out pipe 61 and the first flow-in pipe 62 is blocked. On the contrary, as shown in FIGS. 8 and 14, when the electric switching valve 70 is in the communicated state, the flow-out pipe 61 and the first flow-in pipe 62 are in fluid communication with each other such that water flowing in the first flow-in pipe 62 flows through the electric switching valve 70 into the flow-out pipe 61.

Figure 15:
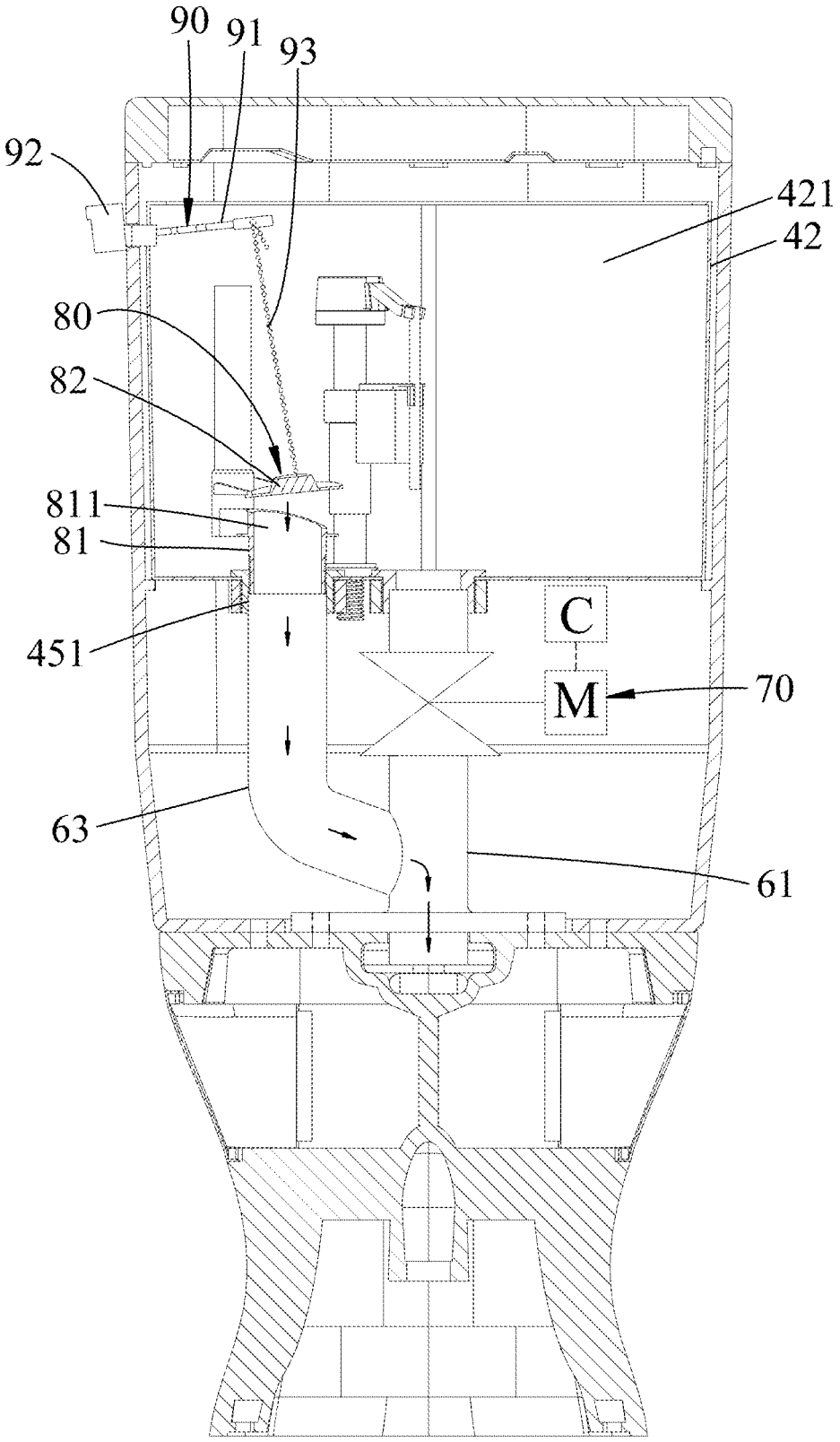
FIG. 15 is a view similar to FIG. 12, but illustrates that the flush valve is moved by a manual actuating unit of the embodiment to an open state.

As shown in FIG. 6, the flush valve 80 is disposed upstream of the second flow-in pipe 63 and is switchable between a closed state (see FIG. 6) and an open state (see FIG. 15). As shown in FIG. 6, when the flush valve 80 is in the closed state, fluid communication between the second flow-in pipe 63 and the water storage space 421 is blocked. As shown in FIG. 15, when the flush valve 80 is in the open state, the second flow-in pipe 63 and the water storage space 421 are in fluid communication with each other.

In this embodiment, as shown in FIG. 6, the flush valve 80 includes a valve seat 81 disposed in the water storage space 421 and mounted on an inner surface of the inner tank body 42 to permit the valve seat 81 to be disposed upstream of the second discharging hole 451, and a flapper 82 disposed in the water storage space 421. The valve seat 81 is connected to the second water discharge unit 45, and is formed with a water discharging hole 811 that is in fluid communication with the second discharging hole 451. The flapper 82 is pivotably mounted to the valve seat 81 and is movable relative to the valve seat 81 between a closed position (see FIG. 6) and an open position (see FIG. 15). As shown in FIG. 6, the flapper 82 is configured such that when the flush valve 80 is in the closed state, the flapper 82 is disposed at the closed position to seal the water discharging hole 811 of the valve seat 81 and thus the second discharging hole 451 to block fluid communication between the second flow-in pipe 63 and the water storage space 421. As shown in FIG. 15, the flapper 82 is configured such that when the flush valve 80 is in the open state, the flapper 82 is disposed at the open position and a seal between the flapper 82 and the valve seat 81 is broken. In this way, the second flow-in pipe 63 is in fluid communication with the water storage space 421 via the second discharging hole 451 and the water discharging hole 811.

As shown in FIG. 6, the manual actuating unit 90 is coupled to the flush valve 80 for actuating movement of the flush valve 80 from the closed state (see FIG. 6) to the open state (see FIG. 15).

In this embodiment, the manual actuating unit 90 includes a handle 92 mounted on an outside of the outer tank body 41, a lever 91 disposed in the water storage space 421 of the inner tank body 42 and connected to be actuated by the handle 92, a chain 93 connecting the lever 91 to the flapper 82 such that when the handle 92 is manually actuated to operate the lever 91, the chain 93 is pulled by the lever 91 to thereby move the flapper 82 to move from the close position (see FIG. 6) to the open position (see FIG. 15) and thus move the flush valve 80 from the closed state to the open state.

Figure 10:
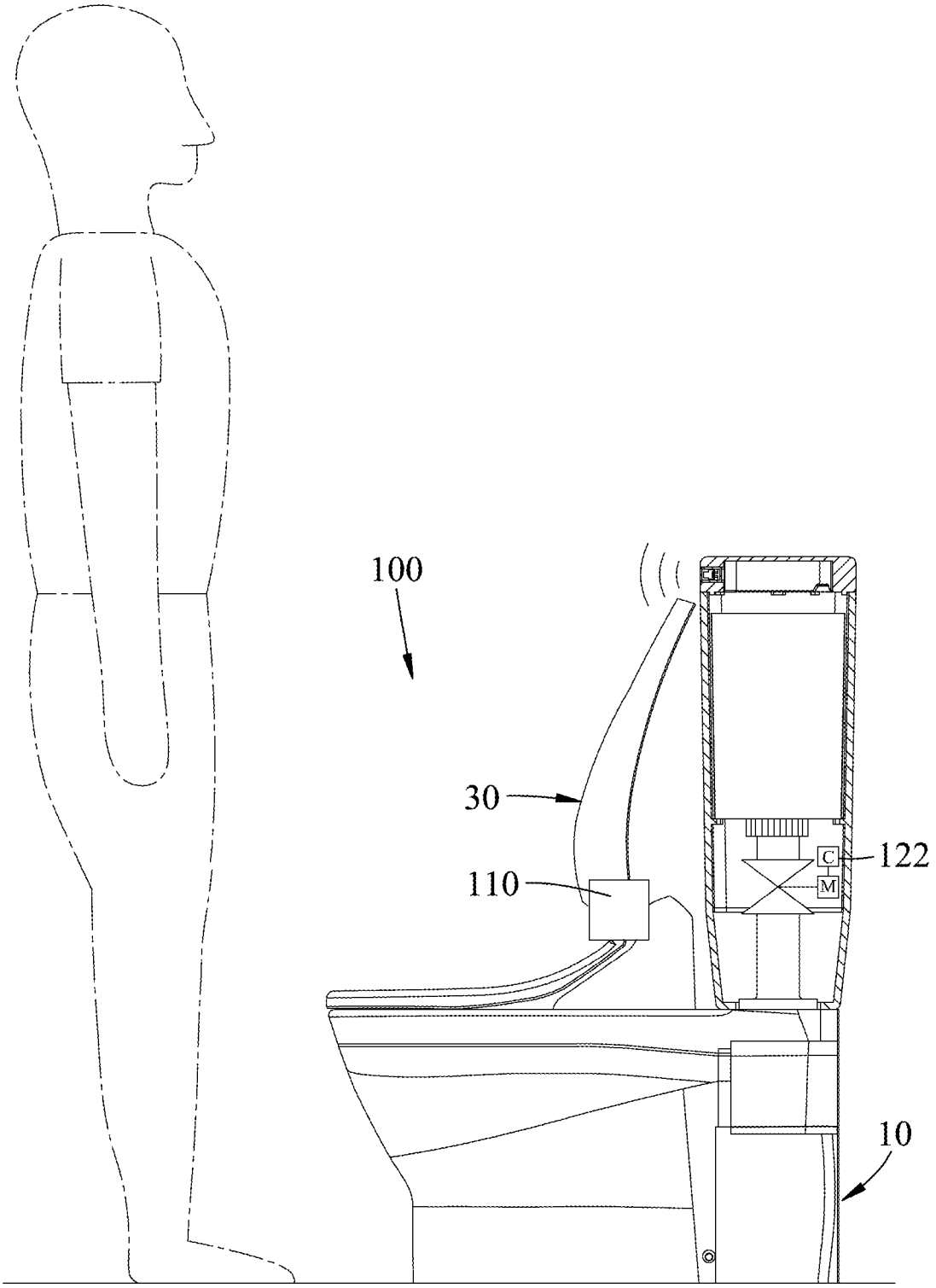
FIG. 10 is a view similar to FIG. 9, but illustrates a toilet cover of the embodiment moved to an uncovering position.

Referring to FIGS. 2, 3 and 5, the driver 110 is mounted to the mounting seat 12 of the toilet stool unit 10 and is coupled to the toilet cover 30 for driving the toilet cover 30 to move between the covering position (see FIG. 5) and the uncovering position (see FIG. 10). In the embodiment, the driver 110 is a reduction motor and is connected to the pivot shaft 32 of the toilet cover 30.

As shown in FIGS. 4 and 5, the sensor control unit 120 includes a sensor 121 disposed in the mounting slot 434, and a controller 122 signally connected to the sensor 121. The controller 122 is signally connected to the electric switching valve 70 and the driver 110 so as to permit a sensing signal from the sensor 121 to be transmitted to the electric switching valve 70 and the driver 110. The sensor control unit 120 is disposed for controlling switching of the electric switching valve 70 between the blocked state (see FIGS. 7 and 12) and the communicated state (see FIGS. 8 and 14) and for controlling the driver 110 to drive the toilet cover 30 to move between the covering position (see FIG. 5) and the uncovering position (see FIG. 10). It should be noted that the number of the sensor 121 may be more than one in other embodiments, and is not limited to this example.

It can be appreciated that the controller 122 may be in signal communication with the sensor 121 through an electric wire (not shown) extending through one of the wiring grooves 422 (see FIG. 4) of the inner tank body 42. In one embodiment, the controller 122 may be set to transmit a control signal to the drive motor 73 a predetermined time (for example, 1 second) after the controller 122 has received the sensing signal from the sensor 121. Furthermore, the controller 122 may be set to keep the electric switching valve 70 in the communicated state for a predetermined period (for example, 2.5 seconds), thereby controlling an amount of water for flushing the bowl space 111 of the toilet stool 11.

The sensor 121 may be an ultrasonic sensor, an infrared sensor, a temperature control sensor or a microwave sensor. The controller 122 is a microcomputer controller (MCU) coupled to the electric switching valve 70 and may be integrally formed with the drive motor 73 of the electric switching valve 70. It should be noted that the controller 122 includes a microcontroller or a controller such as, but not limited to, a single core processor, a multi-core processor, a dual-core mobile processor, a microprocessor, a microcontroller, a digital signal processor (DSP), a field-programmable gate array (FPGA), an application specific integrated circuit (ASIC), a radio-frequency integrated circuit (RFIC), etc.

Figure 9:
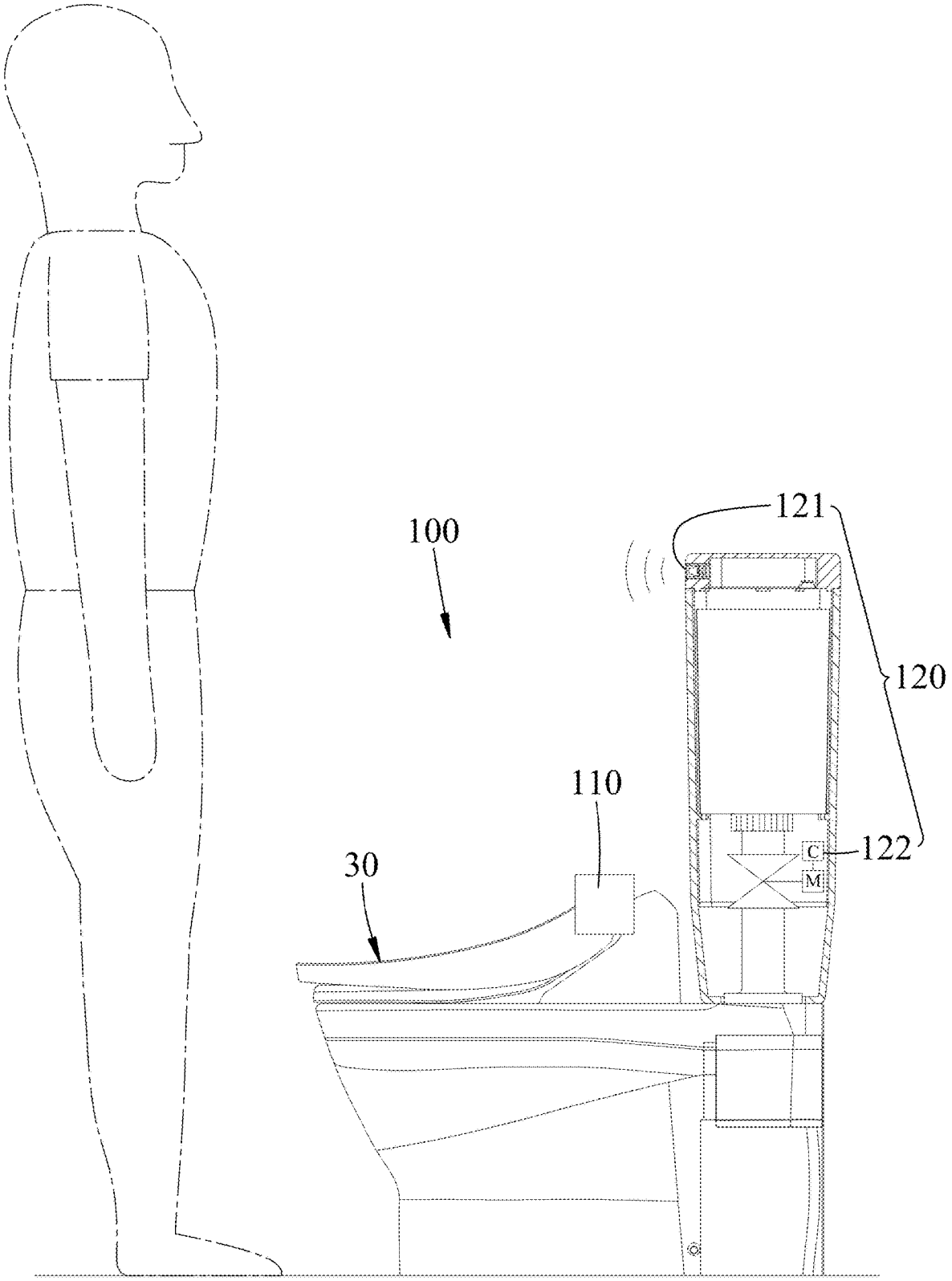
FIG. 9 is a schematic side view illustrating that the sensor of the sensor control unit senses a user who is about to use the flush toilet.
Figure 11:
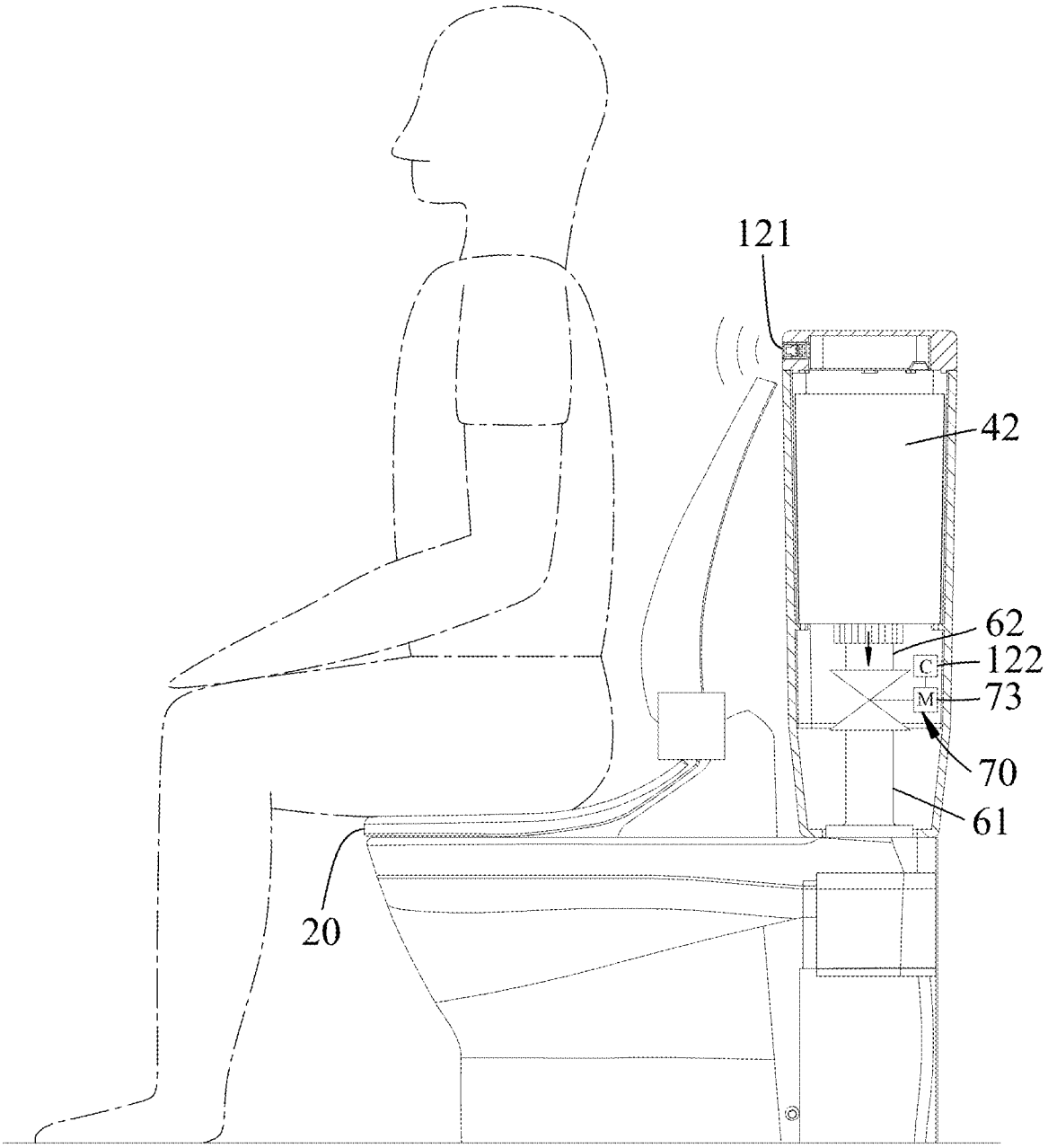
FIG. 11 is a view similar to FIG. 10, but illustrates that the sensor of the sensor control unit senses the user who is using the flush toilet.
Figure 13:
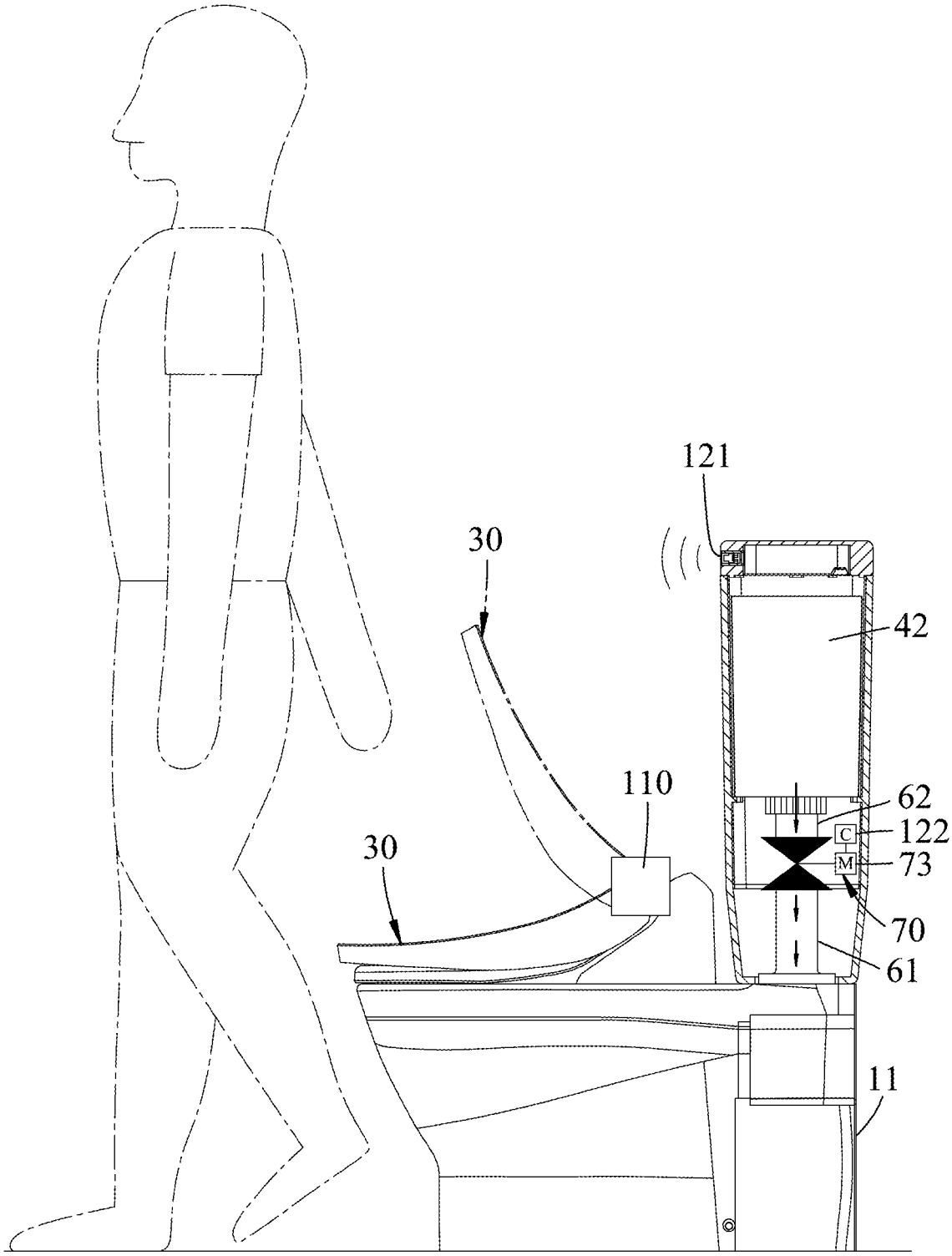
FIG. 13 is a view similar to FIG. 11, but illustrates that the sensor of the sensor control unit senses the user who has finished using the flush toilet.

In this way, as shown in FIG. 9, when the sensor 121 of the sensor control unit 120 senses that the user approaches the flush toilet 100 of the present disclosure, the sensing signal from the sensor 121 is transmitted to the controller 122. When the controller 122 determines that the user stays beside the flush toilet 100 for less than a stagnation time (e.g., 3 seconds), the toilet cover 30 is not driven by the controller 122 to move to the uncovering position. As shown in FIG. 10, in a case where the controller 122 determines that the user stays beside the flush toilet 100 for more than the stagnation time (e.g., 3 seconds), the driver 110 is driven by the controller 122 to move the toilet cover 30 to the uncovering position from the covering position. Subsequently, as shown in FIGS. 11 and 12, when the sensor 121 detects that the user is seated on the toilet seat 20, the sensor 121 transmits the sensing signal to the controller 122, and thereafter the controller 122 transmits the control signal to the drive motor 73. At this point, the electric switching valve 70 is kept in the blocked state. As such, water in the water storage space 421 does not flow into the flow-out pipe 61 through the first discharging hole 441 of the first water discharge unit 44, the first flow-in pipe 62, and the electric switching valve 70. Referring to FIGS. 13 and 14, after the sensor 121 detects that the user has left from the toilet seat 20, the sensor 121 transmits another sensing signal to the controller 122. The controller 122 may be set to transmit another control signal to the drive motor 73 and the driver 110 a predetermined time (e.g., 1 second) after the controller 122 received the another sensing signal from the sensor 121, so as to switch the electric switching valve 70 to the communicated state and to move the toilet cover 30 from the uncovering position to the covering position by the driver 110. In this way, during movement of the toilet cover 30 from the uncovering position to the covering position, water in the storage space 421 flows into the flow-out pipe 61 sequentially through the first discharging hole 441 of the first water discharge unit 44, the first flow-in pipe 62, and the electric switching valve 70 for flushing away excreta inside the bowl space 111. A flushing period (e.g., 2.5 seconds) is determined by the predetermined period during which the electric switching valve 70 is kept in the communicated state, and may be controlled by the controller 122 to thereby control the amount of water for the flushing. After the flushing period, the controller 122 transmits the control signal to switch the electric switching valve 70 back to the blocked state (see FIG. 12) so as to stop flushing.

As shown in FIG. 15, in a case where the electric switching valve 70 is unable to be driven, e.g., under a blackout condition, a user may manually press down the handle 92 of the manual actuating unit 90 to operate the lever 91 and the chain 93, so as to thereby move the flapper 82 to the open position, i.e., to switch the flush valve 80 to the open state. In this case, water in the water storage space 421 flows into the flow-out pipe 61 through the second discharging hole 451 and the second flow-in pipe 63, thereby flushing the excreta inside the bowl space 111 away. After the user releases the handle 92, the flush valve 80 returns to the closed state (FIG. 12) to stop the flushing.

Through the above description, the advantages of the present disclosure can be summarized as follows.

First, with the provision of the pipe unit 60 in cooperation with the electric switching valve 70, and the sensor control unit 120 for automatically controlling the switch of the electric switching valve 70 between the blocked state and the communicated state, automatic flushing of the flush toilet 100 of the embodiment may be achieved. Therefore, the flush toilet 100 may be useful for maintaining a hygienic environment for the next user.

Second, by virtue of the design of the sensor control unit 120 controlling movements of the electric switching valve 70 and the driver 110, the toilet cover 30 may be moved to the covering position during flushing. In this way, water splashes generated during flushing may be effectively prevented from splashing out of the toilet stool 11, thereby maintaining a hygienic environment.

Third, by virtue of the controller 122 of the sensor control unit 120 controlling the driver 110 to drive movement of the toilet cover 30 to the uncovering position, the toilet cover 30 may be moved to the uncovering position only when the controller 122 determines that the user stays beside the flush toilet 100 for more than the stagnation time.

Fourth, under a blackout condition or when a malfunction of the electric switching valve 70 occurs, the manual actuating unit 90 may be manually operated to switch the flush valve 80 to the open state and thus the flapper 82 to the open position for flushing. Thus, the flush toilet 100 of the embodiment is still operable under the blackout condition.

Fifth, since the communication hole 721 of the valve gate 72 of the electric switching valve 70 has a dimension the same as an inner diameter of each of the flow-out pipe 61 and the first flow-in pipe 62, when the electric switching valve 70 is switched to the communicated state, a sufficient amount of water from the flow-out pipe 61 is provided for flushing the toilet stool 11.

Sixth, the controller 122 of the sensor control unit 120 may be set to control the predetermined period during which the electric switching valve 70 is kept in the communicated state, thereby controlling the flushing period and the amount of the water for flushing the toilet stool 11. Therefore, the controller 120 may be useful for water-saving.

In summary, the flush toilet 100 of the present disclosure may automatically flush, and the toilet cover 30 is also automatically driven to move to the covering position during flushing. In addition, the flush toilet 100 is still operable under a blackout condition to provide a hygienic environment.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A flush toilet comprising:

a toilet stool unit that defines a bowl space;

a toilet seat that is pivotably disposed on said toilet stool unit;

a toilet cover that is pivotably mounted to said toilet stool unit, and that is movable relative to said toilet stool unit between a covering position to close said bowl space and an uncovering position to open said bowl space;

a water tank unit that includes an outer tank body, an inner tank body disposed in said outer tank body and defining a water storage space therein, and a cover member disposed detachably on a top portion of said outer tank body, and having a front side that is formed with a mounting slot extending therethrough;

a pipe unit that includes a flow-out pipe in fluid communication with said bowl space and disposed upstream of said bowl space, a first flow-in pipe disposed downstream of said water storage space and in fluid communication with said water storage space, and a second flow-in pipe disposed downstream of said water storage space and in fluid communication with said flow-out pipe;

an electric switching valve that is connected in series between said flow-out pipe and said first flow-in pipe, and that is switchable between a blocked state and a communicated state, fluid communication between said flow-out pipe and said first flow-in pipe being blocked when said electric switching valve is in the blocked state, said flow-out pipe and said first flow-in pipe being in fluid communication with each other when said electric switching valve is in the communicated state;

a flush valve that is disposed upstream of said second flow-in pipe and that is switchable between a closed state and an open state, fluid communication between said second flow-in pipe and said water storage space being blocked when said flush valve is in the closed state, said second flow-in pipe and said water storage space being in fluid communication with each other when said flush valve is in the open state;

a manual actuating unit that is coupled to said flush valve for actuating movement of said flush valve from the closed state to the open state;

a driver that is mounted to said toilet stool unit, and that is coupled to said toilet cover for driving said toilet cover to move between the covering position and the uncovering position; and a sensor control unit that includes at least one sensor disposed in said mounting slot, and a controller signally connected to said at least one sensor, and signally connected to said electric switching valve and said driver, said sensor control unit being disposed for controlling switching of said electric switching valve between the blocked state and the communicated state, and for controlling said driver to drive said toilet cover to move between the covering position and the uncovering position.

2. The flush toilet as claimed in claim 1, wherein:

said toilet stool unit includes a toilet stool defining said bowl space, and a mounting seat disposed on a top surface of said toilet stool;

said outer tank body is disposed on said top surface of said toilet stool and is adjacent to a rear portion of said toilet stool;

said mounting seat is adjacent to said outer tank body;

said toilet seat is pivotably disposed on said mounting seat;

said toilet cover is pivotably mounted to said mounting seat; and said driver is mounted to said mounting seat.

3. The flush toilet as claimed in claim 1, wherein said controller of said sensor control unit is a microcomputer controller (MCU) that is coupled to said electric switching valve.

4. The flush toilet as claimed in claim 3, wherein said at least one sensor is one of an ultrasonic sensor, an infrared sensor, a temperature control sensor, and a microwave sensor.

5. The flush toilet as claimed in claim 1, wherein:

said water tank unit further includes a first water discharge unit disposed in said inner tank body, and a second water discharge unit disposed in said inner tank body;

said first water discharge unit defines a first discharging hole disposed downstream of said water storage space;

said first flow-in pipe is connected to said first water discharge unit and is disposed downstream of said first discharging hole;

said second water discharge unit defines a second discharging hole disposed downstream of said water storage space; and said second flow-in pipe is connected to said second water discharge unit and is disposed downstream of said second discharging hole.

6. The flush toilet as claimed in claim 5, wherein:

said flush valve includes a valve seat disposed in said water storage space and disposed upstream of said second discharging hole, and a flapper disposed in said water storage space, and movable relative to said valve seat between a closed position and an open position, such that when said flush valve is in the closed state, said flapper is disposed at the closed position to seal said valve seat and to block fluid communication between said second flow-in pipe and said water storage space, and such that when said flush valve is in the open state, said flapper is disposed at the open position and a seal between said flapper and said valve seat is broken to allow fluid communication between said second flow-in pipe and said water storage space; and said manual actuating unit includes a handle mounted on an outside of said outer tank body, a lever disposed in said water storage space, and connected to be actuated by said handle, and a chain connecting said lever to said flapper, such that when said handle is manually actuated to operate said lever, said chain is pulled by said lever to thereby move said flush valve to the open state from the closed state.

7. The flush toilet as claimed in claim 5, wherein:

said first water discharge unit is mounted to a bottom portion of said inner tank body and extends through said inner tank body such that said first discharging hole is disposed downstream of said water storage space; and said second water discharge unit is mounted to said bottom portion of said inner tank body and extends through said inner tank body such that said second discharging hole is disposed downstream of said water storage space.

8. The flush toilet as claimed in claim 1, wherein said water tank unit further includes a water inlet valve disposed in said inner tank body and having a bottom portion that extends through and outwardly of said inner tank body.

9. The flush toilet as claimed in claim 1, wherein:

said cover member has a cover top wall, and a cover peripheral wall extending downwardly from a periphery of said cover top wall and having said front side of said cover member, said cover top wall and said cover peripheral wall cooperatively defining an inner space; and said mounting slot is formed in said cover peripheral wall and is in fluid communication with said inner space.

10. The flush toilet as claimed in claim 1, wherein said outer tank body includes a periphery wall, and a plurality of blocks disposed on an inner surface of said periphery wall and protruding inwardly therefrom;

said inner tank body has a bottom surface abutting against said blocks; and said inner tank body has an outer peripheral surface formed with at least one wiring groove.

* * * * *